United States Patent [19]

Klingenberg

[11] 4,362,397

[45] Dec. 7, 1982

[54] ANALOG-DISPLAY TIMEPIECE

[76] Inventor: Hans U. Klingenberg, 3274 St. Niklaus bei Merzligen (Canton of Berne), Switzerland

[21] Appl. No.: 191,497

[22] Filed: Sep. 29, 1980

[30] Foreign Application Priority Data

Oct. 9, 1979 [CH] Switzerland ..... 9079/79

[51] Int. Cl.[3] ..... G04B 19/20

[52] U.S. Cl. ..... 368/233; 368/234; 368/77

[58] Field of Search ..... 368/77, 220, 234, 297, 368/298–300, 322, 323, 233, 232, 223, 221

[56] References Cited

U.S. PATENT DOCUMENTS

| | | | |
|---|---|---|---|
| 1,185,624 | 6/1915 | Boylen | 368/88 |
| 2,642,713 | 6/1953 | Prins | 368/234 |
| 3,307,346 | 3/1967 | Klingenberg | 368/294 |

FOREIGN PATENT DOCUMENTS

| | | | |
|---|---|---|---|
| 773185 | 11/1934 | France | 368/220 |
| 983245 | of 0000 | France . | |
| 183259 | of 0000 | Switzerland . | |
| 307045 | of 0000 | Switzerland . | |
| 312519 | of 0000 | Switzerland . | |
| 676261 | of 0000 | United Kingdom . | |

*Primary Examiner*—Bernard Roskoski

*Attorney, Agent, or Firm*—Stevens, Davis, Miller & Mosher

[57] ABSTRACT

Instead of conventional hands, an hour disc and a minute disc are provided. The hands are represented by markers vaporized upon the undersides of the discs. The discs are pivoted on an arbor anchored in the watch glass. This arbor is hollow, and inserted in the free end thereof is a rivet-shaped retaining part which keeps the discs from slipping off the arbor. Each disc is toothed at its circumference. The teeth of the minute disc engage a gear wheel having a pinion which meshes with the teeth of the hour disc. This wheel and pinion are mounted on an arbor, one end of which is anchored in the watch glass. A retaining ring prevents the wheel from becoming detached from the arbor. This gear wheel likewise engages a pinion of another gear wheel mounted on an arbor. One end of this arbor is also anchored in the watch glass. A pinion of a stepping motor meshes with the teeth of the further gear wheel. The yoke of the stepping motor is rigidly connected to the watch glass by means of bolts which likewise have one end anchored in the watch glass. A shaft bearing the pinion and the rotor of the stepping motor is pivoted at one end in a recess in the watch glass. Because all the parts necessary for driving the discs, as well as the discs themselves, are either fixed to the watch glass or pivoted about arbors anchored in the watch glass, plates can be dispensed with, so that manufacture of the timepiece is considerably simplified.

7 Claims, 8 Drawing Figures

ANALOG-DISPLAY TIMEPIECE

This invention relates to analog-display timepieces, and more particularly to a timepiece of the type having a glass, discs rotatingly disposed on an arbor under the glass for analogically indicating the time, and drive means for rotating the discs.

Analog-display timepieces described in Swiss Pat. No. 307,045 and in the associated Swiss Patents of Addition Nos. 312,519 and 312,520 comprise, instead of conventional hands, transparent discs on which markers are painted for indicating the time. One of the discs, viz., the hour disc, is connected to the barrelcover. Each of the two discs is borne by a metal gear rim, the rotary motion of the hour disc being transmitted to the minute disc by means of a gear train engaging the two gear rims. At the periphery of the minute-disc gear rim is an inwardly-directed radial groove into which fingers project which are disposed at regular intervals on a raised rim of the plate. These fingers guide and hold the disc for rotation. Disposed between the first and second discs as a dial is a stationary blanked annular disc.

In conventional timepieces of the prior art, a completely assembled movement is fitted into a case provided with a glass and closed by a back cover.

It is an object of this invention to provide an improved timepiece which can be assembled from just one side and is of considerably simpler construction than prior art timepieces.

To this end, the timepiece according to the present invention is characterized in that the arbor about which the discs are rotatable is rigidly secured at only one end to the inner side of the glass, and that a retaining member is affixed to the free end of the arbor to prevent detachment of the discs.

Figure 1:
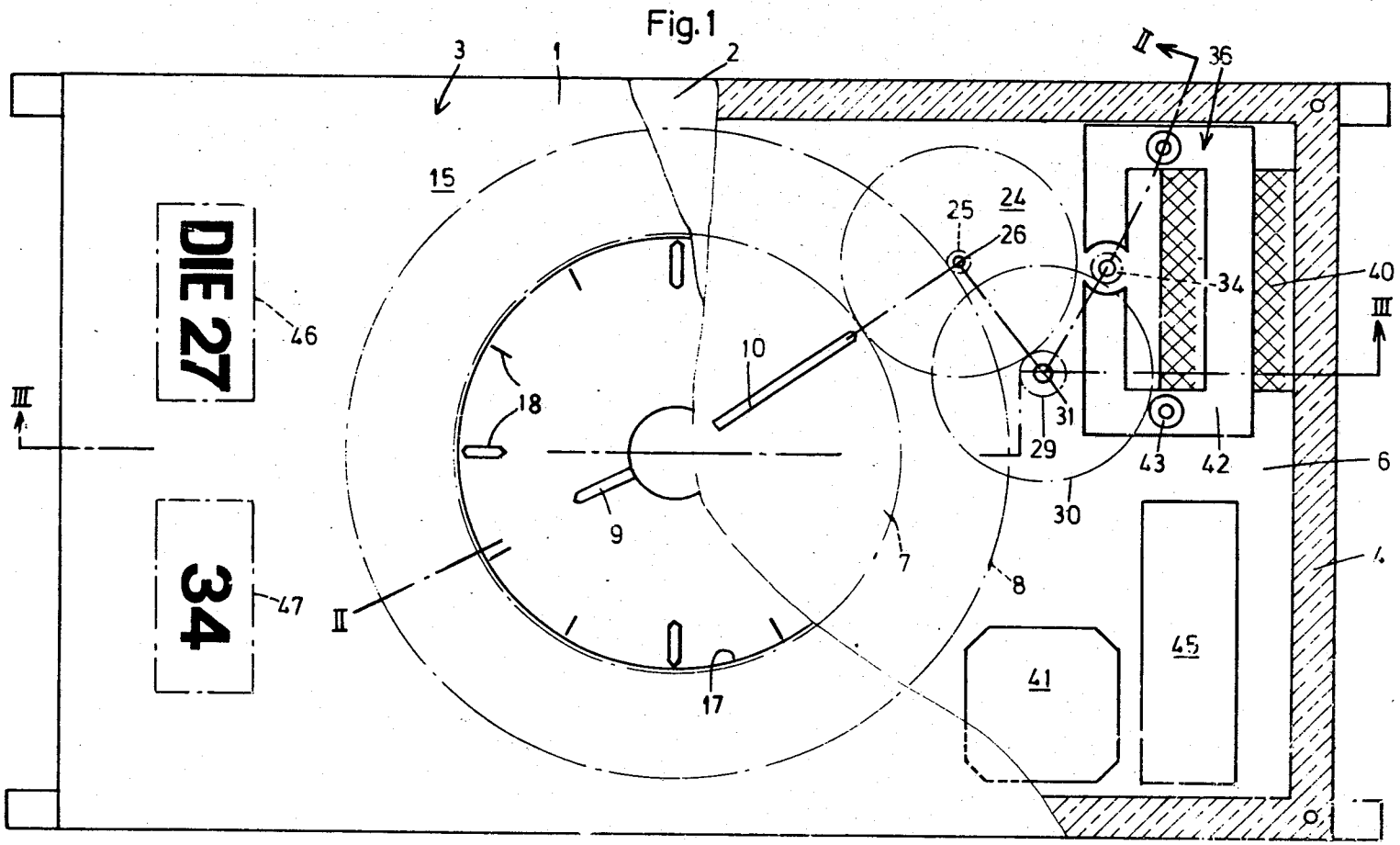
Figure 2:
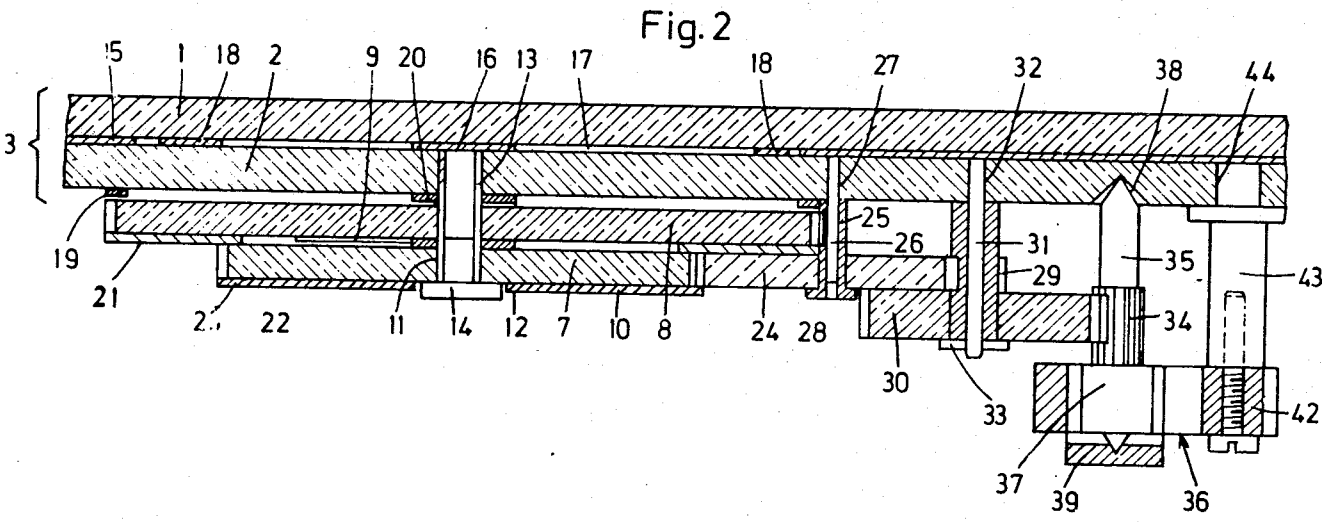
Figure 3:
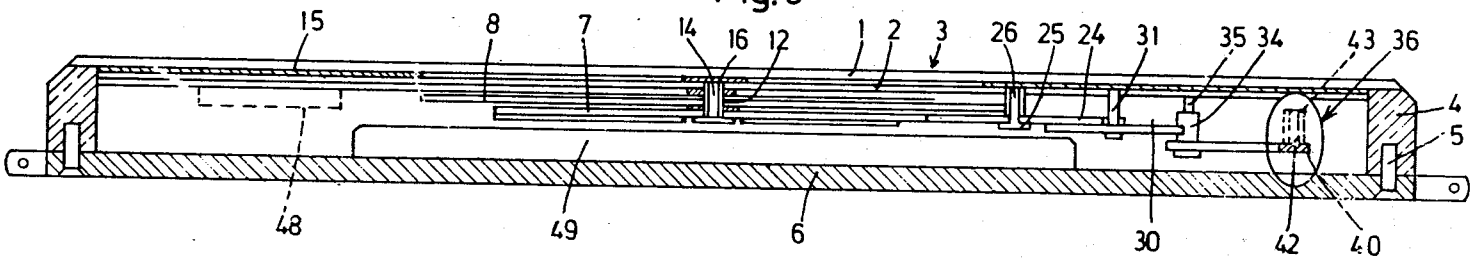
Figure 4:
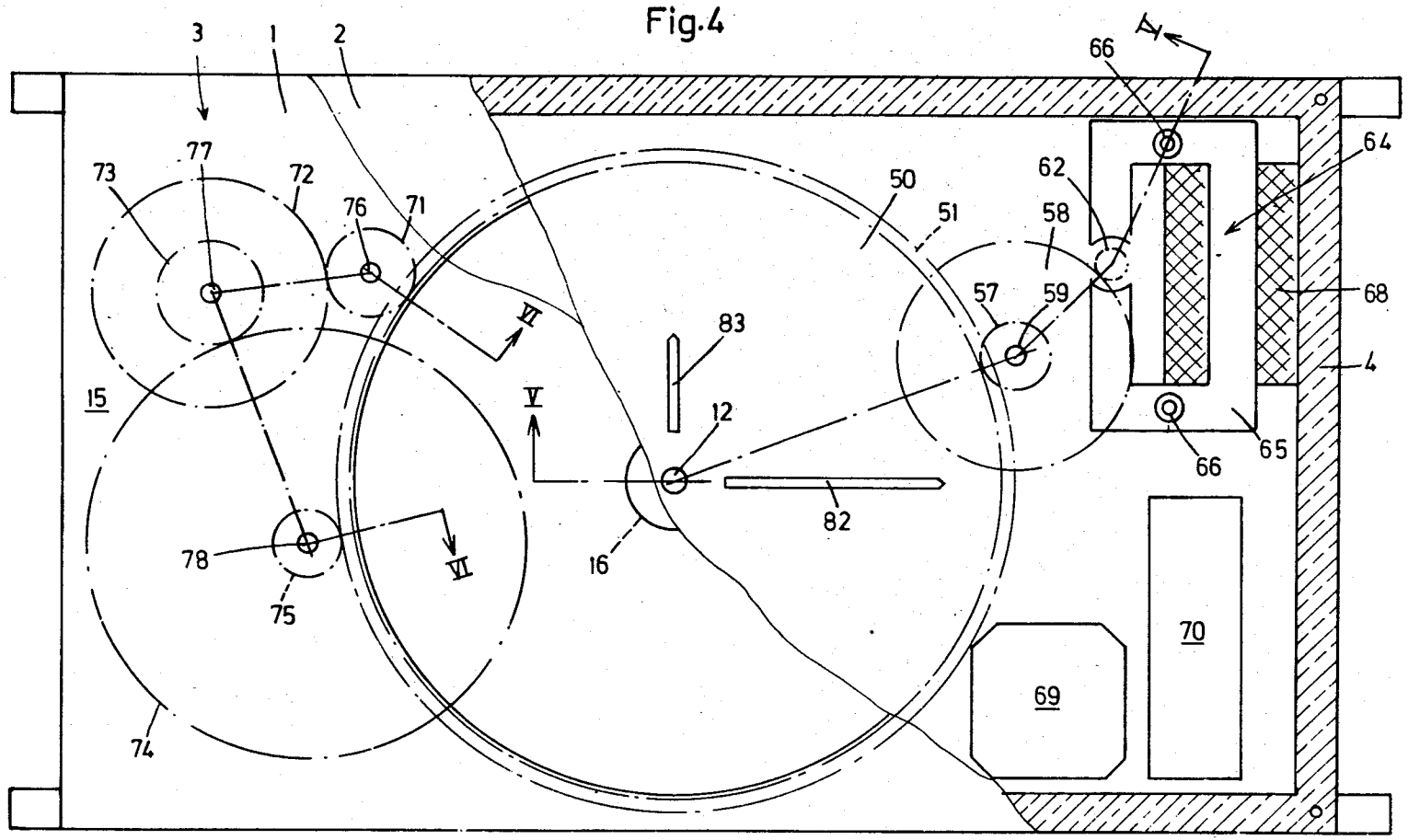
Figure 5:
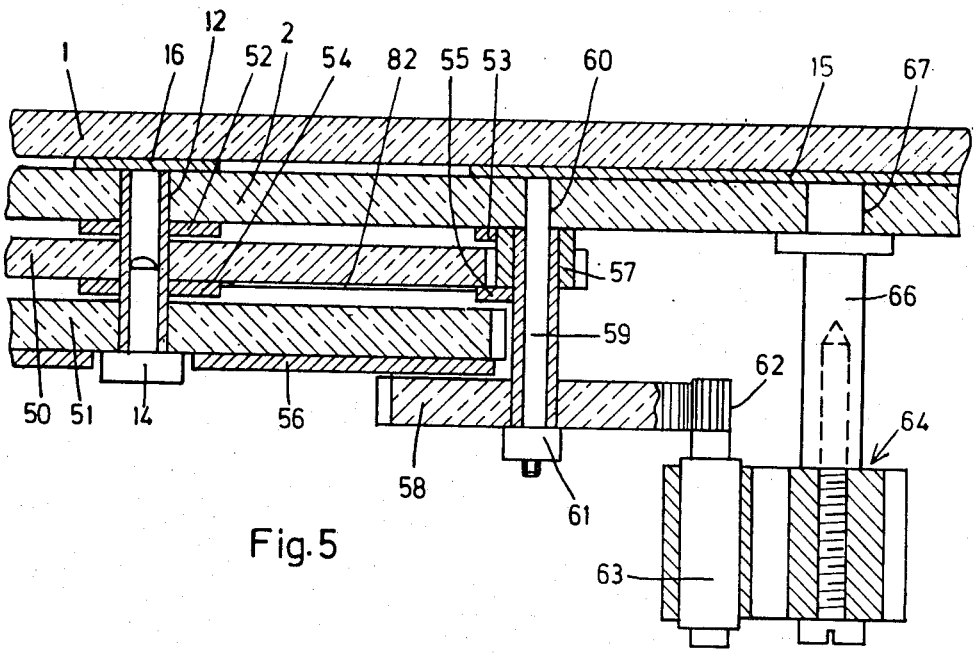
Figure 6:
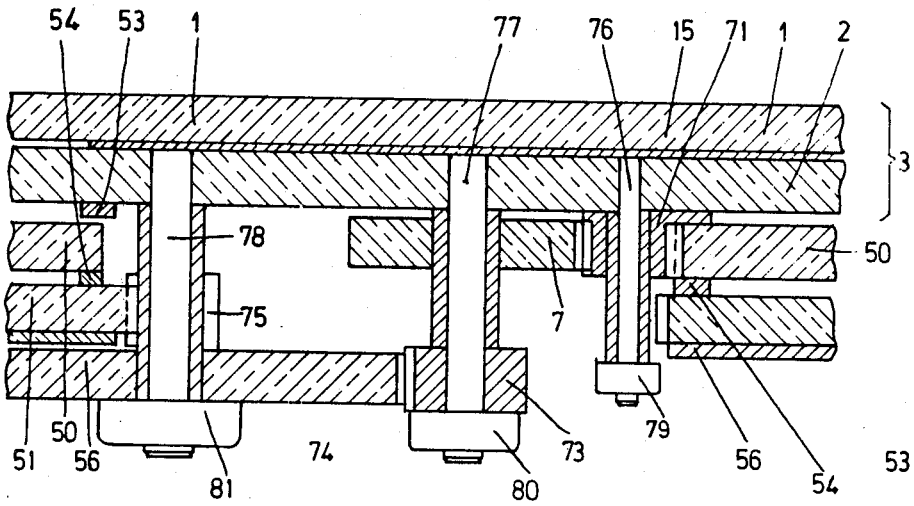
Figure 7:
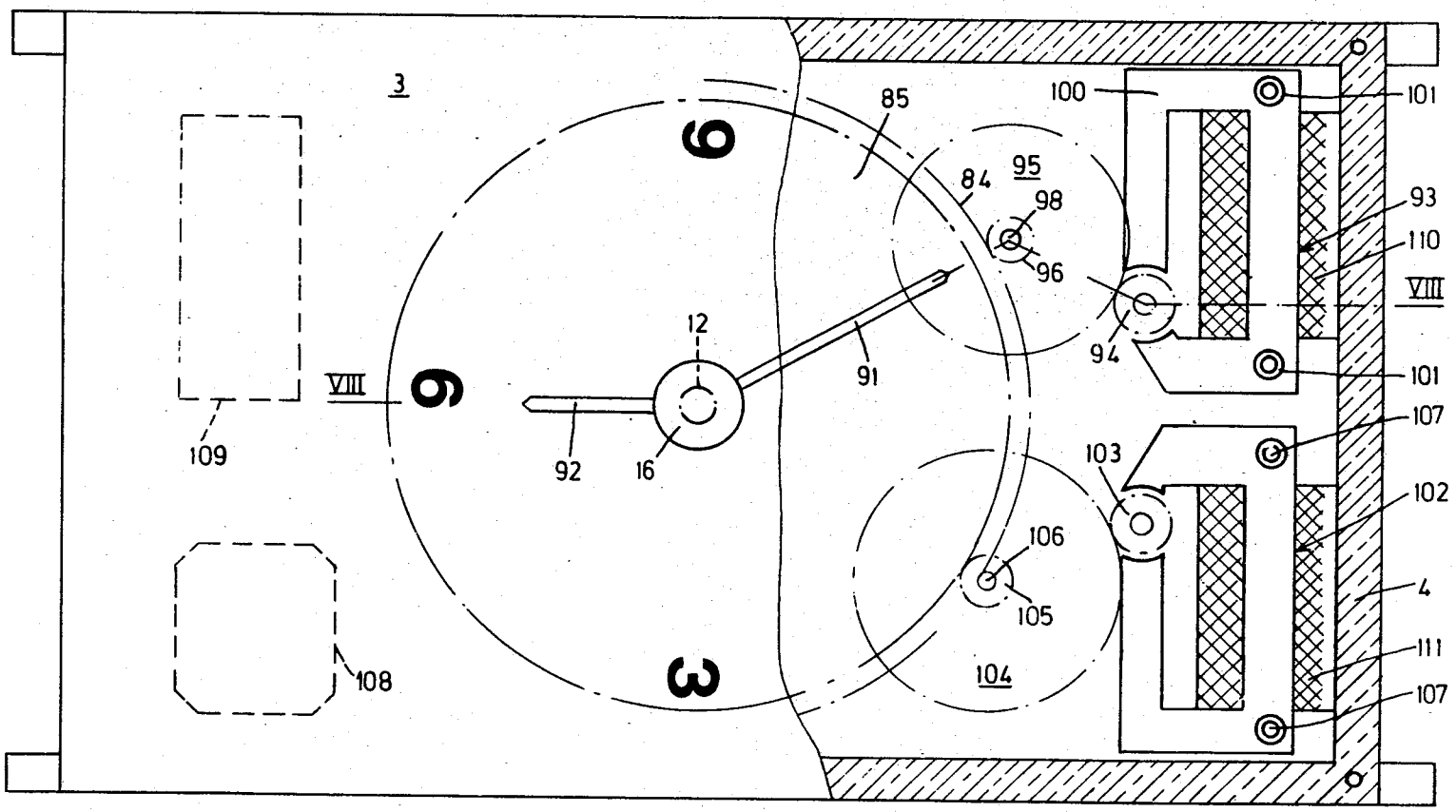
Figure 8:
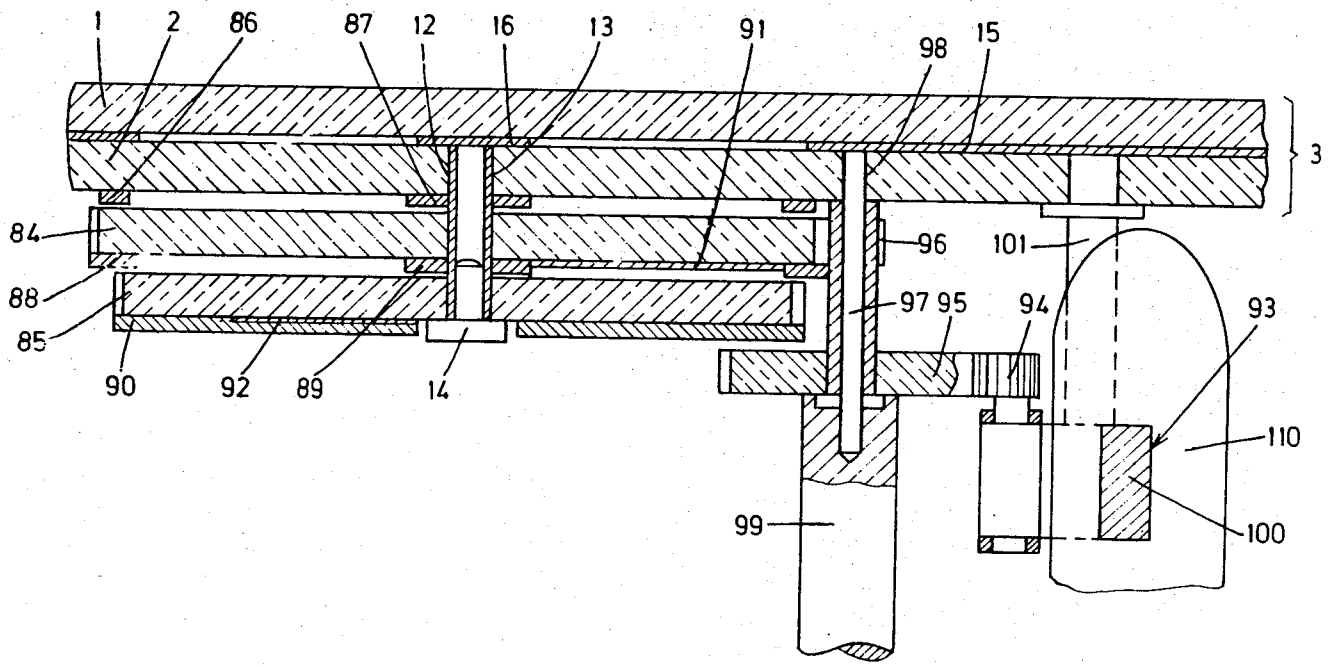

Preferred embodiments of the invention will now be described in detail with reference to the accompanying drawings, in which:

FIG. 1 is a top plan view of a first embodiment of the timepiece according to the invention, certain portions being cut away, FIG. 2 is a section taken on the line II—II of FIG. 1, FIG. 3 is a section taken on the line III—III of FIG. 1, FIG. 4 is a top plan view of a second embodiment, partially cut away, FIG. 5 is a section taken on the line V—V of FIG. 4, FIG. 6 is a section taken on the line VI—VI of FIG. 4, FIG. 7 is a top plan view of a third embodiment, partially cut away, and FIG. 8 is a section taken on the line VIII—VIII of FIG. 7.

FIGS. 1-3 show an embodiment of the invention in the form of a flat watch. As may best be seen from FIG. 3, this watch comprises a glass 3 composed of an outer slab 1 and an inner slab 2, a caseband 4, and a metal back 6 fastened to the caseband 4 by means of screws 5. The thicknesses of the components as they appear in FIG. 3, i.e., their vertical dimensions, are enlarged about three times as compared with their horizontal dimensions in that drawing figure.

In FIG. 2, a section taken on the line II—II of FIG. 1, only the essential parts of the watch are shown, their thickness being greatly exaggerated. Instead of conventional hands, the watch depicted in FIG. 1 has a transparent minute disc 7 and a transparent hour disc 8. On the underside of the disc 7 there is a marker 10 to indicate the minutes, and on the underside of the disc 8 there is a marker 9 to indicate the hours.

The two discs 7 and 8 are of a hard, transparent material such as sapphire, ruby, spinel, or mineral glass. The discs each include a central opening 11 and are pivoted on a hollow arbor 12. One end of the arbor 12 is firmly anchored, e.g., by means of an adhesive, in a hole 13 in the inner glass slab 2. A retaining part 14 having a head and a shank keeps the discs 7 and 8 from becoming detached from the arbor 12.

The adjacent faces of the outer slab 1 and the inner slab 2 of the watch glass 3 each include a marginal area 15 and a central area 16, in each of which areas a layer of metal is applied by vaporization or electroplating. In these areas the outer and inner slabs 1 and 2 are fixed to one another, e.g., by cementing, soldering, or sintering. In the middle region of the watch glass 3 there remains an annular zone 17 which is transparent, so that the markers 9 and 10 are visible.

Dividing marks 18 are vaporized or electroplated upon the underside of the outer glass slab 1 to facilitate telling the time. These marks 18 might be applied to the underside of the inner slab 2 instead.

Applied to the undersides of the inner slab 2 and of the hour disc 8 in two annular areas of each are vaporized or electroplated metal layers 19, 20 and 21, 22, respectively. These thin, annular layers of metal act as spacers and bearing surfaces for the discs 7 and 8 which rotate relative to the watch glass 3. The underside of the minute disc 7 is provided with an annular metal layer 23, the inside diameter of which is larger than the head of the retaining part 14. Thus, the part 14 can rest lightly against the hard, smooth surface of the minute disc 7 so that friction is kept to a minimum. The outside and inside diameters of the aforementioned annular layers of metal 19-23 are such that they overlap, so that when the watch is viewed from the exterior, a substantially uniform background is visible. The one end of the arbor 12 may also be cemented or soldered to the metal layer 20 on the inside of the glass 3, in which case the spacing between the glass 3 and the hour disc 8 will then be correspondingly greater. Furthermore, provision may also be made for a hole in the outer glass slab 1 corresponding to the hole 13 in the inner slab 2. The arbor 12 may then extend through the slab 1 as well as through the slab 2. A head (not shown) may be affixed to the part of the arbor 12 projecting above the outside of the outer slab 1 so that the arbor 12 is firmly anchored in the watch glass 3. This design is of interest particularly when the glass 3 is made in one piece.

The discs 7 and 8 are each provided with peripheral teeth. Those of the minute disc 7 engage the teeth of a minute-wheel 24, the pinion 25 of which meshes with the teeth of the hour disc 8. The dimensions of the minute-wheel 24 and the pinion 25 are such that the hour disc 8 completes one revolution for every twelve rotations of the minute disc 7. The wheel 24 and the pinion 25 are mounted on an arbor 26, one end of which is firmly anchored in a hole 27 in the inner glass slab 2. A retaining member 27 prevents the wheel 24 from becoming detached from the arbor 26. The minute-wheel 24 is preferably made of the same material as the minute disc 7 so that there is as little friction as possible between the wheel 24 and the annular layer 21 on the hour disc 8. The wheel 24 further engages a pinion 29 of a minute-wheel 30, the latter two components being pivoted on an arbor 31, one end of which is anchored in a hole in the inner slab 2 in the same way as the aforementioned end of the arbor 26. A retaining ring 33 ensures that the wheel 30 cannot become detached from the arbor 31.

The minute-wheel 30 is driven by a pinion 34 mounted on a shaft 35 of a stepping motor 36. One end of the shaft 35, which extends through the rotor 37 of the motor 36, is pivoted in a recess 38 in the inner glass slab 2, while the other end is pivoted in a depression in a bearing cap 39.

The winding 40 of the stepping motor 36 is supplied by an electronic circuit 41, shown only schematically in FIG. 1, with three pulses per minute, whereby the rotor 37 of the motor 36 turns through 180° per pulse. A yoke 42 forming the magnetic circuit of the stepping motor is rigidly connected to the watch glass 3 by means of bolts 43, the ends of which are anchored in holes 44 in the inner slab 2. The bearing cap 39, preferably made of a non-magnetic material, is secured to the yoke 42.

The electronic circuit 41 and a quartz crystal holder 45 are fixed to the underside of the inner slab 2. The respective area of the inner slab is metallized and serves not only for the fixation of the components 41 and 45 but also for grounding the electronic circuit 41, the quartz crystal holder 45, and the stepping motor 36. This metallization also extends over part of the inside of the caseband 4 and the area of contact between the caseband 4 and the back 6. In the metallized marginal area 15 between the outer slab 1 and the inner slab 2, apertures 46 and 47 as shown in dot-dash lines in FIG. 1 may be left free. Beneath the aperture 46, for example, a liquid crystal display device 48 may be disposed for indicating the day and the date, and a further liquid crystal display (not shown) may be disposed beneath the aperture 47 for indicating the seconds. These display devices, too, may be secured directly to the underside of the inner glass slab 2.

It will be clearly apparent from the foregoing description that in this embodiment of the invention, all of the inner components of the watch are borne by the watch glass 3. Only a battery 49 is fixed to the back 6. This watch is very easy to assemble. The watch glass 3 with the caseband 4 secured thereto is laid in the "dial down" position, whereupon the discs 7 and 8, the minute-wheels 24 and 30 with their pinions, and the stepping motor 36 can be inserted and fitted from one side with utmost simplicity, the watch glass 3 serving so to speak as the plate. The battery 49 may even be integrated in the back 6.

A second embodiment of the invention is illustrated by means of a top plan view and two sections in FIGS. 4–6, the thickness of the components shown in FIGS. 5 and 6 being greatly exaggerated. Since the watch glass covering the entire watch is designed in essentially the same way as for the watch depicted in FIGS. 1–3, the same reference numerals are used for the watch glass in FIGS. 4–6. The metallized marginal area 15 and central area 16 between the outer glass slab 1 and the inner glass slab 2 are likewise similar to the corresponding areas in FIGS. 1–3. The hollow arbor 12 is rigidly anchored in a hole 13 in the center of the inner slab 2.

Adjacent to the inner slab 2, a minute disc 50 is pivoted on the arbor 12, followed by an hour disc 51 pivoted on the same arbor. The disc 51 is somewhat larger in diameter than the disc 50, and each of these discs is provided with peripheral teeth. The retaining part 14 prevents the discs 50 and 51 from becoming detached from the arbor 12.

Applied to the underside of the inner slab 2 are a central annular metal layer 52 and an outer annular metal layer 53, while a central annular metal layer 54 and an outer annular metal layer 55 are applied to the underside of the minute disc 50. These layers of metal serve as spacers and as bearing surfaces between the glass slab 2 and the disc 50, and between the disc 50 and the disc 51, respectively. Except for the central area, the underside of the hour disc 51 is likewise provided with a metal layer 56.

The teeth of the minute disc 50 engage a pinion 57 of a minute-wheel 58, both mounted on an arbor 59 having one end anchored in a hole 60 in the inner slab 2. A retaining ring 61 prevents the wheel 58 from becoming detached from the arbor 59.

The minute wheel 58 meshes with a pinion 62 mounted on the same shaft as a rotor 63 of a stepping motor 64. The yoke 65 of the motor 64 is rigidly connected to the watch glass 3 by means of bolts 66, the ends of which are firmly anchored in corresponding holes 67 in the inner slab 2. The winding 68 of the motor 64 is not visible in FIG. 5 because this figure is a section through only one corner of the motor 64. Three pulses per minute are supplied to the winding 68 by an electronic circuit 69. As a result, the rotor 62 of the motor 64 rotates 90 times per hour. The minute-wheel 58 with its pinion 58 ensures that the minute disc 50 completes one revolution per 90 revolutions of the rotor 62. Disposed adjacent to the circuit 69 is a crystal holder 70 containing a quartz crystal (not shown) cooperating with the circuit 69. Both the circuit 69 and the crystal holder 70 are secured to the underside of the inner glass slab 2.

The motion of the minute disc 50 is transmitted to the hour disc 51 via a gear train shown diagrammatically at the left-hand side of FIG. 4 and in section in FIG. 6. The teeth of the minute disc 50 drive an idle wheel 71 which also meshes with a minute-wheel 72. The pinion 73 of the wheel 72 engages another minute-wheel 74, the pinion 75 of which meshes with the teeth of the hour disc 51. The gear train just described ensures that the hour disc 51 turns once for every twelve rotations of the minute disc 50. The wheel 72 is mounted on an arbor 76, the wheel 72 on an arbor 77, and the wheel 74 on an arbor 78, one end of each of these arbors being anchored in a corresponding hole in the inner glass slab 2. Affixed to the free ends of the arbors 76, 77, and 78 are retaining rings 79, 80, and 81, respectively, in order that wheels 71, 72, and 74 may not become detached from their associated arbors. In order to reduce the friction between the minute-wheel 74 and the hour disc 51 to which the metal layer 56 is applied, the wheel 74, like the discs 50 and 51, is preferably made of sapphire, spinel, or mineral glass.

A marker 82 representing the minute hand is applied by vaporization or electroplating to the underside of the minute disc 50, and a marker 83 representing the hour hand is similarly applied to the underside of the hour disc 51.

A third embodiment of the invention is illustrated in FIGS. 7 and 8, the thickness of the components again being greatly exaggerated in the latter sectional view. Since the watch glass 3 and the caseband 4 are of similar design to those shown in FIGS. 1–3, they are designated by the same reference numerals. Pivoted on the hollow arbor 12 anchored in the central hole 13 of the inner glass slab 2 are a minute disc 84 and an hour disc 85. The retaining part 14 keeps the discs 84 and 85 from slipping off the arbor 12. Applied to the undersides of the slab 2 and the disc 84 are annular metal layers 86, 87 and 88, 89, respectively, serving as spacers and bearing surfaces. The underside of the disc 85 is coated with a metal layer 90 except for the central area thereof. Markers 91 and 92 representing the minute and hour hands are likewise applied to the undersides of the minute disc 84 and the hour disc 85, respectively, the hour marker 92 being embedded in the metal layer 90.

The minute disc 84 is driven by a first stepping motor 93, a pinion 94 of which in turn drives a minute-wheel 95 having a pinion 96 engaging the teeth of the minute disc 84. The wheel 95 and its pinion 96 are pivoted on an arbor 97, one end of which is anchored in a hole 98 in the inner glass slab 2. Instead of there being a retaining ring at the other end of the arbor 97, an extension piece 99 extends from the back (not shown in FIG. 8) up to the wheel 95 so that the latter cannot become detached from the arbor 97 when the back is in place. The yoke 100 of the motor 93 is rigidly connected to the watch glass 3 by bolts 101.

The hour disc 85 is driven by a second stepping motor 102. The pinion 103 of the motor 102 drives a wheel 104 having a pinion 105 which engages the teeth of the hour disc 85. The wheel 104 and its pinion 105 are pivoted on an arbor 106 which is anchored in the inner glass slab 2 in the same way as the arbor 97. A further extension piece (not shown) ensures that wheel 104 cannot slip off the arbor 106 when the back is in place. The stepping motor 102 is rigidly connected to the watch glass 3 in the same way as the motor 93 by means of bolts 107.

An electronic circuit 108 and a quartz crystal holder 109 are fixed to the underside of the inner slab 2 on the side of the watch opposite the motors 93 and 102, as viewed in FIG. 7. The circuit 108 is designed to supply three pulses per minute to the winding 110 of the stepping motor 93 and only one-twelfth as many pulses during the same period of time to the winding 111 of the second stepping motor 102, i.e., the winding 111 receives one pulse every four minutes.

In all three of the embodiments described above, the timepiece is a watch provided with a rectangular case. It will be understood, however, that other shapes can be used as well, e.g., round or oval. What is significant is that virtually all components of the timepiece are fixed to the glass itself or pivoted on arbors fixed to the glass. Although the general inventive concept is particularly suited to the manufacture of flat wrist watches, other timepieces such as pocket watches, alarm clocks, or wall-clocks can also be constructed in accordance with the indications given above. When the thickness of the timepiece to be produced is of secondary importance, greater spacing can naturally be provided between the glass and the minute disc, on the one hand, and between the minute and hour discs, on the other hand. Furthermore, synchronous motors or conventional spring motors can be used to drive the gear trains instead of stepping motors.

If the flat watches described above are also filled after their assembly with a dielectric liquid, e.g., a silicone or paraffin oil, as disclosed in U.S. Pat. No. 4,080,781, friction between the various moving parts can be reduced. Moreover, the compressive strength and shock-resistance of the watch are increased thereby.

Between the back and the innermost disc of each of the watches described above, there is a relatively large space for accommodating the battery necessary for operating the watch. This battery has a large base surface but is not all too high. The capacity of the battery is determined by its volume, which is merely a linear function of the height but a quadratic function of the diameter.

The timepieces described above have neither a dial nor a plate because the glass itself serves as a plate, and the dial is formed by the overlapping layers of metal beneath the minute and hour discs. These timepieces can be conveniently and simply assembled and put into operation from just one side.

What is claimed is:

1. A timepiece of the type having a glass, two or more discs rotatingly disposed under said glass for analogically indicating the time, and drive means for rotating said discs, wherein the improvement comprises:

an arbor having a first end rigidly secured to the underside of said glass, a second end of said arbor being remote from said glass and remaining free, and said discs being pivoted about said arbor, and a retaining member affixed to said second end of said arbor for preventing detachment of said discs from said arbor, said drive means comprising a plurality of gear wheels and pinions and a plurality of arbors about which said gear wheels and pinions are respectively pivoted, each of said plurality of arbors having a first end secured to or in said glass whereby sole support for said drive means is derived from said glass.

2. The timepiece of claim 1, wherein said glass comprises an outer glass slab having metallized areas on the underside thereof and an inner glass slab disposed under said outer glass slab, said inner glass slab having metallized areas on the surface thereof facing said outer glass slab, being cemented, soldered, or sintered to said outer glass slab at least in said metallized areas, and including a plurality of holes, said one end of said arbor being anchored in one of said holes.

3. The timepiece of claim 1 or claim 2, wherein said discs are of sapphire, ruby, spinel, or mineral glass, each of said discs including an external toothing at the circumference thereof.

4. The timepiece of claim 3, further comprising a plurality of layers of metal vaporized or electroplated on certain areas of the inner faces of said glass and of said discs, at least some of said layers acting as spacers between said glass and one of said discs and between said discs.

5. The timepiece of claim 1, wherein said drive means further comprise a stepping motor having a shaft and a rotor fixed to said shaft, said motor being bolted to said glass, and one end of said shaft being pivoted in said glass.

6. The timepiece of claim 5, wherein one of said discs is drivenly connected to said stepping motor via one of said gear wheels and one of said pinions, said drive means further comprising an additional stepping motor, another one of said discs being drivenly connected to said additional stepping motor via another one of said gear wheels and another one of said pinions.

7. The timepiece of claim 1 or claim 5, wherein one or more of said gear wheels are of mineral glass, spinel, or sapphire.

* * * * *